United States Patent [19]

St. Peter

[11] Patent Number: 4,881,676

[45] Date of Patent: Nov. 21, 1989

[54] THUMBTACK TOOL

[76] Inventor: Larry St. Peter, 521 Division St., Hubbell, Mich. 49934

[21] Appl. No.: 194,220

[22] Filed: May 16, 1988

[51] Int. Cl.[4] ..... B25C 1/02

[52] U.S. Cl. ..... 227/63; 227/147

[58] Field of Search ..... 227/63, 147

[56] References Cited

U.S. PATENT DOCUMENTS

| | | | |
|---|---|---|---|
| 1,369,420 | 2/1921 | Gillespie et al. | 227/63 |
| 2,094,459 | 9/1937 | Lipson | 1/47 |
| 2,533,112 | 12/1950 | Hayden | 1/47 |
| 2,780,811 | 2/1957 | Rodin | 1/47 |
| 2,929,067 | 3/1960 | Tupta | 1/47 |
| 3,009,155 | 11/1961 | Leniz | 1/46 |
| 3,218,030 | 11/1965 | Baro | 254/18 |
| 3,250,308 | 5/1966 | March | 227/63 V |
| 3,549,075 | 12/1970 | Tsunemi | 227/63 |

FOREIGN PATENT DOCUMENTS

| | | | |
|---|---|---|---|
| 436771 | 11/1926 | Fed. Rep. of Germany | 227/63 |
| 18427 | of 1890 | United Kingdom | 227/63 |

*Primary Examiner*—Paul A. Bell

*Attorney, Agent, or Firm*—Michael, Best & Friedrich

[57] ABSTRACT

A hand-held tool for holding a thumbtack and applying force to the thumbtack in order to insert or remove the thumbtack from a surface. The tool includes a clip adapted to house the head of the thumbtack and a pistol shaped hand grip. The clip and hand grip allow application of force to be applied to the thumbtack through the tool. Additionally, the tool provides storage for a supply of thumbtacks in a cavity in the pistol-grip.

8 Claims, 1 Drawing Sheet

THUMBTACK TOOL

BACKGROUND OF THE INVENTION

The invention relates generally to tools for inserting and removing fasteners, and more particularly to a tool for holding, inserting and removing a thumbtack from a surface.

In the use of thumbtacks there is a need for a tool through which force can be applied to the thumbtack for the insertion and removal of the thumbtack. The invention provides a tool with a grip which facilitates the application of force to the thumbtack. The invention also provides a tool with a grip which includes means for storage of a supply of thumbtacks.

Examples of prior art tools for inserting and removing fasteners such as thumbtacks are illustrated in the following patents: U.S. Lipson Pat. No. 2,094,459 issued Sep. 28, 1937, Hayden U.S. Pat. No. 2,533,112 issued Dec. 5, 1950, Rodin U.S. Pat. No. 2,780,811 issued Feb. 12, 1957, Tupta U.S. Pat. No. 2,929,067 issued Mar. 22, 1960, Leniz U.S. Pat. No. 3,009,155 issued Nov. 21, 1961, and Baro U.S. Pat. No. 3,218,030 issued Nov. 16, 1965.

SUMMARY OF THE INVENTION

The invention provides a tool for supporting a thumbtack which has a head and a pointed shaft extending from the head. The tool provides a means for applying force to the thumbtack for insertion of the thumbtack shaft into a surface or for removal of the shaft from a surface. The tool includes a body having a forward end and a rearward end, the forward end including means for releaseably engaging the head of the thumbtack with the shaft projecting forwardly. The rearward end of the tool includes a means for gripping the tool and applying force to the thumbtack through the body of the tool.

In one embodiment, the means for releaseably engaging the head of the thumbtack includes a pair of parallel members joined by a bite portion which together form a U-shaped clip member. The parallel members are spaced apart and adapted to slideably house at least a portion of the head of the thumbtack therebetween. One of the parallel members is attached to the forward end of the tool body. The other of the parallel members includes a central slot. The central slot is of a sufficient width to allow the shaft of the thumbtack to slide into the slot and to be housed in the slot with the pointed end of the shaft projecting forwardly through the slot away from the body.

In one embodiment, the means of gripping the tool and applying force to the thumbtack through the body of the tool includes at least a portion of the body and the rearward end formed as a pistol shaped grip which includes a cavity which provides means for storage of a supply of thumbtacks.

In one embodiment, the parallel members are generally planar and have lower portions joined by the bite portion, such that the central slot opens upwardly.

In one embodiment, the parallel members and the bite portion, which together comprise the clip member, defines a cavity therebetween which opens upwardly.

It is an object of the invention to provide a tool with means to apply force to a thumbtack to insert the thumbtack or to remove the thumbtack. One of the features or advantages of the construction embodying this invention is that the clip member slideably engages the thumbtack and allows the application of force to the thumbtack for both insertion and removal. Additionally, the embodiment of the tool in the form of a pistol grip facilitates the application of force through the tool to the thumbtack for both insertion and removal of the thumbtack. In addition, an embodiment of the invention in the form of a pistol grip may provide or certify for storage of a supply of thumbtacks.

Various other features and advantages of the invention will become apparent to those skilled in the art upon review of the following detailed description, claims and drawings.

Before one embodiment of the invention is explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 5:
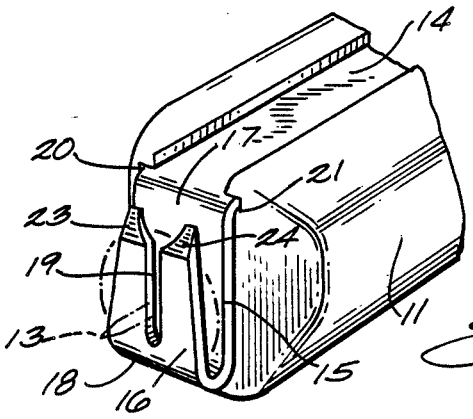
FIG. 5 is a partial perspective of the forward end of a thumbtack tool illustrating the invention supporting a thumbtack.

A thumbtack tool embodying the invention is illustrated in the drawings.

Figure 4:
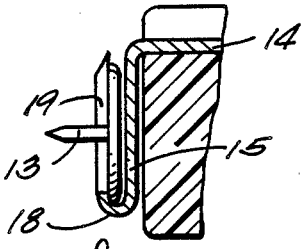
FIG. 4 is an expanded side view of the forward end of a thumbtack tool illustrating the invention supporting a thumbtack.
Figure 3:
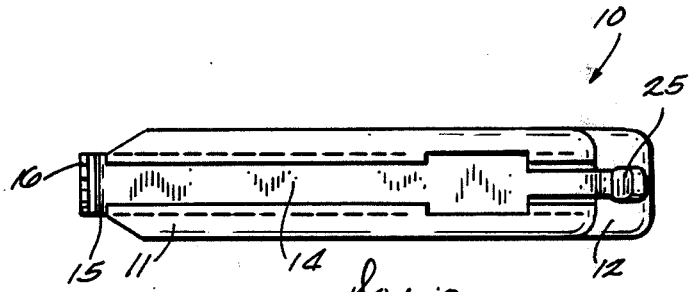
FIG. 3 is a plan view of a thumbtack tool embodying the invention.
Figure 2:
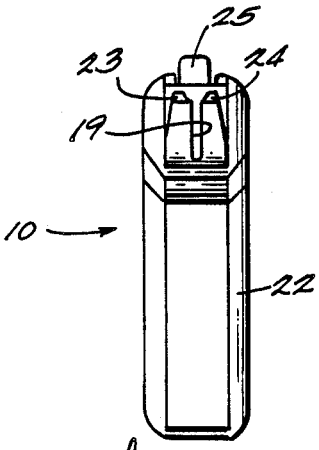
FIG. 2 is a frontal view of a thumbtack tool embodying the invention.

The tool comprises a body 10, having a forward end 11 and a rearward end 12. The forward end supports a clip 15 for gripping a thumbtack 13. While not illustrated in all of the drawings, the thumbtack 13, held by clip 15, is shown in FIG. 4 and in phantom lines in FIG. 5.

The clip 15 is an integral part of an elongated strip 14, the end of strip 14 being bent in a U-shape to form clip 15. Clip 15 has two generally parallel sides 16 and 17 joined at their lower ends by a bite 18.

The parallel sides 16 and 17 are spaced apart sufficiently to accommodate the head of thumbtack 13. One of the parallel sides, 16, has a slot 19 which opens in an upward direction. This slot has a width sufficient to receive the shaft of the thumbtack and so that the thumbtack shaft extends forwardly and away from the end 11 of the thumbtack tool. The other parallel side, 17, is an integral Part of the remainder of planar strip 14 and strip 14 is held in the thumbtack tool body by opposed slots 20 and 21. In this manner, the planar strip 14 is slidable in slots 20 and 21 and relative to the body of the thumbtack tool.

Rearward end 12 of the tool includes a depending portion 22 which is shaped in the nature of a pistol grip. The pistol grip 22 provides an effective mechanism for applying a force through the body of the thumbtack tool such that a thumbtack held by clip 15 can be inserted into a surface. Similarly, the grip provides a mechanism whereby a pulling force can be applied to the thumbtack tool for removal of a thumbtack from a surface.

The upper ends of side 16 on either side of slot 19 have beveled surfaces 23 and 24. These beveled surfaces facilitate inserting the clip 15 under a thumbtack to position the slot 19 over the thumbtack shaft and position the thumbtack head for removal from the surface in which it is embedded.

The end 25 of strip 14 opposite to the end carrying clip 15 is specially formed to hold the strip 14 on the body against longitudinal movement when a force is being applied to remove the thumbtack. More specifically, the end is bent in a general U-shape form to provide detent 26 which would engage the body at 27 when the removal force is being applied. With this arrangement, an adequate force can be applied to the thumbtack for removal but that force will not cause relative movement between strip 14 and the body of the thumbtack tool.

A cavity 28 is provided in the pistol grip portion 22 of the thumbtack tool. This cavity serves as a storage space for a supply of thumbtacks.

Figure 1:
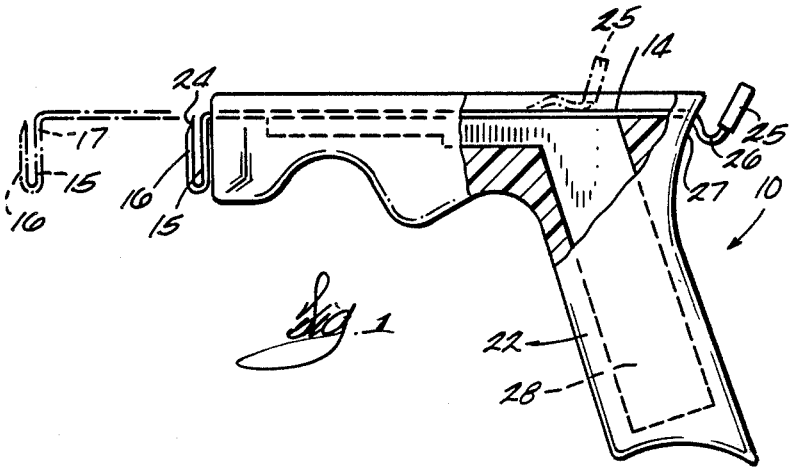
FIG. 1 is a side view of a thumbtack tool embodying the invention.

While the strip 14 is in the full line position illustrated in FIG. 1, it covers the access opening 30 to the cavity. Strip 14 is flexible and the end 25 of strip 14 can be moved upwardly, as viewed in FIG. 1, and toward the left to move the strip 14 to the dotted line position in FIG. 1 to open cavity 12 and permit thumbtacks to be either loaded into or removed from the storage cavity.

This construction provides a compact and effective tool for insertion and/or removal of thumbtacks and also a storage space for a thumbtack supply.

I claim:

1. A tool for supporting a thumbtack having an enlarged head and a shaft extending away from the head, the tool comprising a body having a first elongated portion having a longitudinal axis and a forward end, said body also having a second generally elongated portion spaced from said forward end and extending laterally of said longitudinal axis in the form of a pistol grip, said forward end supporting means for releaseably gripping the thumbtack for insertion into a surface and for releaseably gripping the thumbtack for removal from a surface, said gripping means including a U-shaped clip member having a pair of parallel members joined by a bite portion, said parallel members being spaced apart nd adapted to slideably house at least a portion of the head of the thumbtack therebetween, one of said parallel members including a portion slideably engaged with the forward end of said body and the other of said parallel members including a central slot adapted to house a portion of the shaft of the thumbtack with the pointed shaft of the thumbtack projecting forwardly through the slot away from the body.

2. A tool for supporting a thumbtack as set forth in claim 1 wherein said parallel members are generally planar and each parallel member has a lower portion joined by said bite portion such that said central slot opens upwardly.

3. A tool for supporting a thumbtack as set forth in claim 2 wherein said parallel members and said bite portion define a cavity therebetween, said cavity opening upwardly and defined so as to retain the head of a thumbtack placed in the U-shaped clip member.

4. A tool for supporting a thumbtack as set forth in claim 3 wherein said pistol grip portion includes means defining a cavity adapted to house a supply of thumbtacks; the pistol grip portion having an opening providing access to the cavity defined in the pistol grip.

5. A tool for supporting a thumbtack, as set forth in claim 4, wherein the tool further comprises means for slideably opening and closing the opening to the cavity, the opening and closing means including the parallel members slideably engaged with the body.

6. A tool for supporting a thumbtack , as set forth in claim 5, wherein said one of the parallel member engaged with the body includes a detent means for releasably securing said opening and closing means in engagement with said body.

7. A tool for supporting a thumbtack having an enlarged head and a pointed shaft extending away from the head, the tool comprising a body having a first elongated portion having a longitudinal axis and a forward end, said body also having a second generally elongated portion spaced from said forward end and extending laterally of said longitudinal axis in the form of a pistol grip, said forward end supporting gripping means for releaseably gripping the thumbtack for insertion into a surface and for releaseably gripping the thumbtack for removal from a surface, said first portion of said body having a rearward end and said pistol grip projecting from said rearward end, said gripping means including a U-shaped clip member having a pair of parallel members, the parallel members being spaced apart and adapted to slideably house at least a portion of the head of the thumbtack therebetween, one of said parallel members including a portion engaged with the forward end of said body and the other of the parallel members including a central slot opening upwardly, the clip member having a bite portion joining said parallel members, said parallel members and said bite portion defining a cavity opening upwardly and adapted to house a portion of the head of the thumbtack with the pointed shaft of the thumbtack projecting forwardly through the central slot, the cavity being defined so as to retain the head of a thumbtack placed in the clip member, said body having a rearward end, the pistol grip including means defining a cavity adapted to house a supply of thumbtacks and the cavity having an opening providing access to the cavity defined in the pistol grip, means for slideably opening and closing the opening to the cavity, the opening and closing means including the one of the parallel members engaged with the body.

8. A tool for supporting a thumbtack, as set forth in claim 7, wherein the tool further comprises means for selectively retaining fixed relation between the body and the gripping means during insertion and removal of the thumbtack from a surface and providing sliding relation therebetween during application of releasing force, the retaining means including a detent located on the portion of the parallel member for releaseable engagement with the body.

* * * * *